US009252504B1

(12) United States Patent
Shechter

(10) Patent No.: US 9,252,504 B1
(45) Date of Patent: Feb. 2, 2016

(54) ELECTRICAL WIRE CONNECTOR

(71) Applicant: Jacob Shechter, Tucson, AZ (US)

(72) Inventor: Jacob Shechter, Tucson, AZ (US)

( * ) Notice: Subject to any disclaimer, the term of this patent is extended or adjusted under 35 U.S.C. 154(b) by 0 days.

(21) Appl. No.: 14/705,441

(22) Filed: May 6, 2015

Related U.S. Application Data

(60) Provisional application No. 62/100,297, filed on Jan. 6, 2015.

(51) Int. Cl.

| | |
|---|---|
| ***H01R 4/22*** | (2006.01) |
| ***H01R 4/12*** | (2006.01) |
| ***H01R 13/52*** | (2006.01) |
| ***H01R 13/68*** | (2011.01) |

(52) U.S. Cl.
CPC ..... *H01R 4/12* (2013.01); *H01R 13/521* (2013.01); *H01R 13/68* (2013.01)

(58) Field of Classification Search
CPC ..... H01R 4/22; H01R 13/187; H01R 4/12; H01R 4/4863
See application file for complete search history.

(56) References Cited

U.S. PATENT DOCUMENTS 1,657,253 A * 1/1928 Fortin ..... 439/788
2,534,881 A * 12/1950 Schroeder ..... 174/84 S
2,959,995 A * 11/1960 Linden ..... 81/120
3,390,227 A * 6/1968 Shlesinger, Jr. ..... 174/84 C
4,454,376 A * 6/1984 Holder et al. ..... 174/87
5,113,037 A * 5/1992 King et al. ..... 174/87
5,151,239 A * 9/1992 King, Jr. ..... 264/272.11
5,267,880 A 12/1993 Tamm
5,439,393 A * 8/1995 Watson ..... 439/578
6,364,721 B2 * 4/2002 Stewart, III ..... 439/784
6,854,996 B2 2/2005 Yaworski et al.
7,419,395 B2 9/2008 Tsuji et al.

* cited by examiner

*Primary Examiner* — Gary Paumen
(74) *Attorney, Agent, or Firm* — Dale J. Ream

(57) ABSTRACT

An electrical wire connector for use in splicing first and second conductors includes a wire housing having a first receptacle defining a first interior cavity and a first open end selectively allowing access to the first interior cavity and a second receptacle defining a second interior cavity and a second open end selectively allowing access to the second interior cavity, the first and second receptacles being operatively coupled to one another and the first and second open ends being opposite one another. First and second wire capturing mechanisms are situated in corresponding first and second openings defined by first and second receptacles, respectively, each wire capturing mechanism being configured to restrict movement of a respective conductor once inserted therethrough. Each receptacle includes a threaded member constructed of conductive material, the threaded members being conductively coupled together such that conductors inserted into respective receptacles are conductively connected.

17 Claims, 7 Drawing Sheets

ELECTRICAL WIRE CONNECTOR

REFERENCE TO RELATED APPLICATIONS

This application claims the benefit of provisional patent application U.S. Ser. No. 62/100,297 filed Jan. 6, 2015 titled Electrical Wire Connector and which is incorporated herein by reference.

FIELD OF THE INVENTION

The present invention relates generally to an electrical splicing connector and, more particularly, to a device that latches onto inserted wires to form an electrically conductive non-slip waterproof connection. The present invention enables electrical conductors to be easily joined together along their longitudinal axis without having to hold the conductors to keep them in place.

BACKGROUND OF THE INVENTION

Because of the delicate nature of electronic components and devices repairs are inevitable. One principle component, and frequently the most susceptible to mechanical damage, is the wiring that is required to communicate electrical signals between components. To address this problem many types of splicing connectors have been 20 designed to function as tools that aid in repairing and modifying the wiring between electronic devices. For instance, devices commonly referred to as "butt connectors" receive the ends of two electrical wires and allows them to be twisted or crimped together to restore an electrical connection.

Although presumably effective for their intended purpose, the existing devices and patent proposals do not effectively capture the ends of wires to be joined, do not provide a waterproof connection, or protect against overheating.

Therefore, it would be desirable to have an electrical wire connector that captures the ends of wires to be electrically connected along the longitudinal axis of each wire so as to prevent slippage while being connected. Further, it would be desirable to have a wire connector that forms a waterproof connection apart from a surrounding environment. In addition, it would be desirable to have an electrical wire connector having a fuse configured to disconnect conductivity between two wire conductors if an excessive current is detected.

SUMMARY OF THE INVENTION

An electrical wire connector according to the present invention for use in splicing first and second conductors includes a wire housing having a first receptacle defining a first interior cavity and a first open end selectively allowing access to the first interior cavity and a second receptacle defining a second interior cavity and a second open end selectively allowing access to the second interior cavity, the first and second receptacles being operatively coupled to one another and the first and second open ends being opposite one another. First and second wire capturing mechanisms are situated in corresponding first and second openings defined by first and second receptacles, respectively, each wire capturing mechanism being configured to restrict movement of a respective conductor once inserted therethrough. Each receptacle includes a threaded member constructed of conductive material, the threaded members being conductively coupled together such that conductors inserted into respective receptacles are conductively connected.

Therefore, a general object of this invention is to provide an electrical wire connector that selectively joins the ends of two electric conductors for the transfer of current.

Another object of this invention is to provide an electrical wire connector, as aforesaid, that receives an end of each wire into a receptacle configured to prevent the wire from slipping out once inserted.

Still another object of this invention is to provide an electrical wire connector, as aforesaid, that that enables a user to splice electrical conductors in line with the longitudinal axis of the conductors.

Yet another object of this invention is to provide an electrical wire connector, as aforesaid, that splices two wires in a waterproof connection.

A further object of this invention is to provide an electrical wire connector, as aforesaid, having a fuse as a safety device to disconnect the circuit of current between the two conductive wires if an excess current is experienced.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
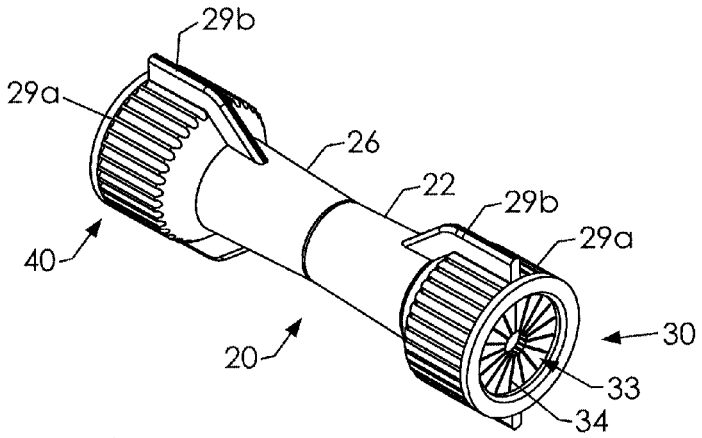
FIG. 1*a* is a perspective view of an electrical wire connector according to one embodiment of the present invention.

An electrical wire connector according to a preferred embodiment of the present invention will be described in detail with reference to FIGS. 1*a* to 4*c* of the accompanying drawings. The electrical wire connector 10 includes a wire housing 20 having first 30 and second 40 receptacles, each receptacle having respective threaded members 35, 45 configured to electrically connect current between respective electrical conductors (i.e. electric wires) inserted into respective ends of respective receptacles.

The preferred embodiment of the present invention is a device that enables a user to splice the ends of two electrical conductors such that the conductors are maintained in waterproof electrical communication. The electrical wire connector 10 is comprised of a wire housing 20 and two sealable apertures. It is an aim of the present invention to provide an apparatus that latches onto inserted wires, facilitating the creation of a non-slip connection between the inserted wires (also referred to as a first conductor and a second conductor) and the electrical wire connector 10. This non-slip connection is established by the wire capturing mechanisms of the wire housing 20, such that as a user inserts an electrical conductor it passes through a latching or capturing mechanism that restricts the conductor from moving in the opposite direction, as will be discussed further below.

The wire housing 20 is the central connection point between two or more wires (i.e. conductors) and is comprised of a first receptacle 30 and a second receptacle 40. The first receptacle 30 defines a first cavity 31 and a first open end 32 that provides access to the first cavity 31. Similarly, the second receptacle 40 defines a second cavity 41 and a second open end 42 that provides access to the second cavity 41. The adjacent coupling of the first receptacle 30 and second receptacle 40 provides a device that enables a user to splice electrical conductors in line with the longitudinal axis of the conductors.

The wire housing 20 is manufactured from materials that insulate the internal conducting elements from the external world. Specifically, the wire housing 20 includes an outer layer constructed of insulated and non-conductive materials. In an embodiment, the wire housing 20 is formed with the first open end 32 of the first receptacle 30 at one end, and the second open end 42 of the second receptacle 40 at the opposite end. Each receptacle is designed to function as a female connector that maintains the ends of an inserted conductor in electrical communication with the conductor inserted into the opposite receptacle.

The first 30 and second 40 receptacles have identical constructions and each includes a wire capturing mechanism and internal threads. More particularly, a first wire capturing mechanism 33 is positioned in the first open end 32 of the first receptacle 30 and a second wire capturing mechanism is positioned in the second open end 42 of the second receptacle 40. In the preferred embodiment of the present invention, each wire capturing mechanism is a pincer type mechanism that latches onto inserted conductors.

The first wire capturing mechanism 33 includes a plurality of latching protrusions 34 extending radially about an opening that are configured to restrict movement of a conductor in an opposite direction once inserted therethrough. Similarly, the second wire capturing mechanism includes a plurality of latching protrusions 44 extending radially about an opening that are configured to restrict movement of a conductor in an opposite direction once inserted therethrough.

In one embodiment, each wire capturing mechanism may include a release mechanism (not shown). The release mechanism may be a semi rigid non-conducting member that extends through the wire housing 20 to connect the wire capturing mechanisms of both of the receptacles. Once a user has inserted conductors into the receptacles, the user may apply pressure to the release mechanism to disengage the wire capturing mechanisms, thus allowing the user to remove inserted conductors. In one embodiment the wire capturing mechanism of each receptacle is equipped with an isolated release mechanism, such that a user is able to disengage the wire capturing mechanism of one receptacle but not the other.

Figure 1B:
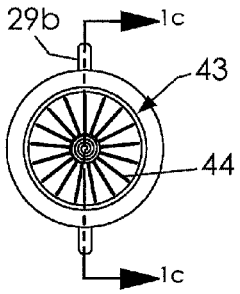
FIG. 1*b* is an end view of the wire connector as in FIG. 1*a;*
Figure 1C:
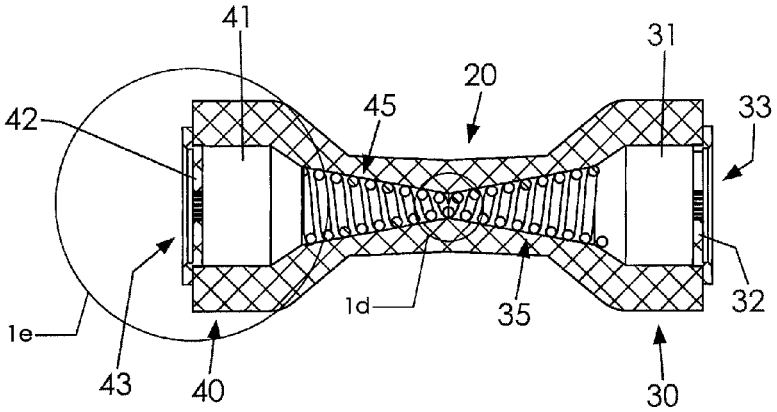
FIG. 1*c* is a sectional view taken along line 1*c*-1*c* of FIG. 1*b;*
Figure 1D:
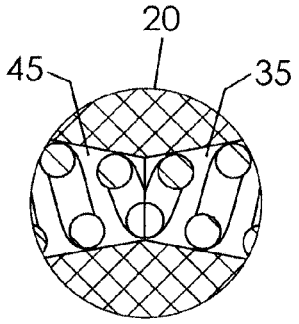
FIG. 1*d* is an isolated view on an enlarged scale taken from FIG. 1*c;*
Figure 1E:
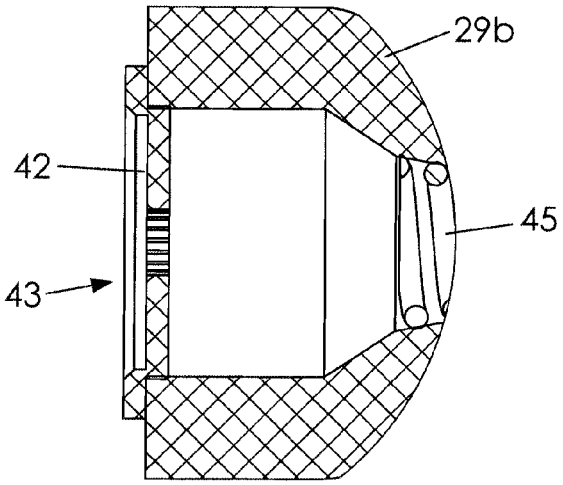
FIG. 1*e* is an isolated view on an enlarged scale taken from FIG. 1*c;*

The first receptacle 30 includes a first threaded member 35 adjacent the first cavity 31 and a second threaded member 45 adjacent the second cavity 41. Both threaded members are constructed of conductive materials, such as including a first metal spring and a second metal spring, respectively. Each threaded member may include a generally conical configuration having an inwardly decreasing diameter such that a conductor inserted therein makes contact with the conductive material. The first threaded member 35 is in operative conductive communication with the second threaded member 45. In one embodiment, respective inner ends of the threaded members may be welded together so as to allow direct conduction of current (FIG. 1*d*). As a result, insertion of first and second conductors (i.e. wires) through respective wire capturing mechanisms 33, 43 and into contact with respective threaded members 35, 45 allows conduction of current between the conductors.

In an embodiment, the internal threaded members 35, 45 are manufactured from electrically conductive materials. In use of the electrical wire connector 10 according to the embodiments described so far, a user twists the conductors as they are inserted into the receptacles, respectively. By twisting the conductor as it is pushed into the receptacle, a conductor engages a respective internal thread member in a manner similar to that of a screw. It is an aim of the present invention to provide an apparatus that maintains a sufficiently robust connection between inserted conductors without the need to be crimped, or mechanically deformed.

With further reference to the wire capturing mechanisms, a waterproof barrier is formed between the conductive components within the wire housing 10 and the external environment. The flexible latching protrusions may be coated with a waterproofing material. The flexible protrusions are positioned around the edges of the a respective open end and extend inward, such that conductors are pushed through the flexible protrusions to form a watertight connection with the electrical components of the wire housing 10. In another embodiment, the waterproofing material may be situated within a respective opening defined by the latching protrusions, such that respective conductors are coated with waterproofing material as they are inserted into the receptacles through respective openings.

In one embodiment, the waterproofing material is a viscous silicone adhesive contained within an internally housed package and released under external pressure. In this embodiment, a user crimps the sealable aperture after the conductors are inserted; thus releasing the waterproofing material and sealing the wire housing 20 chemically as well as mechanically. In another embodiment, the open ends of respective receptacles may be of different sizes useful to mate conductors having dissimilar diameters.

In one embodiment, the wire housing 20 includes a one piece or integrated construction. In other words, the first receptacle 30 and second receptacle 40 are integrally formed within the wire housing 20 (FIGS. 1*a* to 1*c*). In this construction, a user must manually twist a conductor while inserting it into a respective receptacle so that it engages a respective threaded member.

Figure 2A:
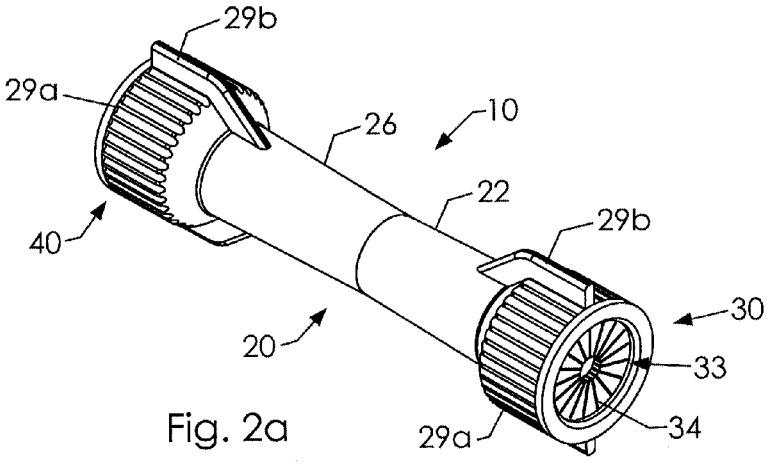
FIG. 2*a* is a perspective view of an electrical wire connector according to another embodiment of the present invention.
Figure 2B:
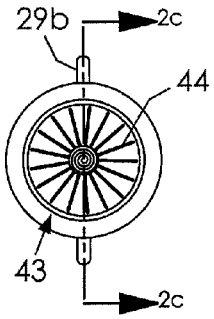
FIG. 2*b* is an end view of the wire connector as in FIG. 2*a;*
Figure 2C:
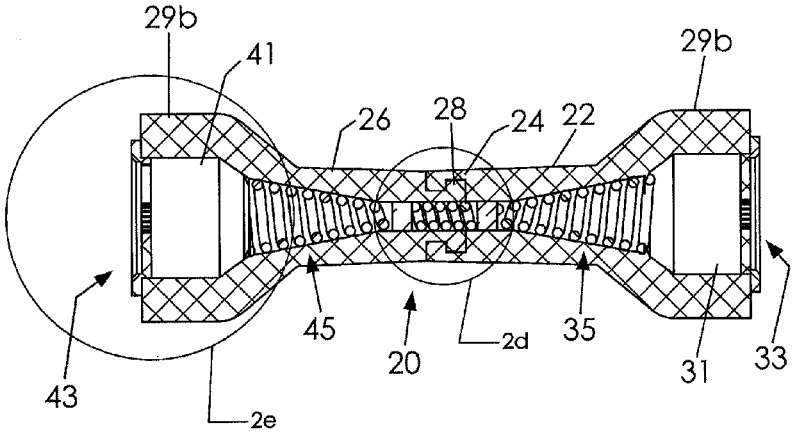
FIG. 2*c* is a sectional view taken along line 2*c*-2*c* of FIG. 2*b;*

In another embodiment, the wire housing 20 may have a two piece construction. More particularly, the wire housing 20 may include a first portion 22 rotatably coupled to a second portion 26 such that the second portion 26 may be selectively rotated relative to the first portion 22 (FIGS. 2*a* to 2*c*). The first portion 22 may have an inner end defining a continuous groove or recess 24 extending circumferentially around the inner end. In a complementary manner, the second portion 26 may include an inner end having a flange 28 selectively nested in the recess 24 such that the portions of the wire housing 20 may be rotated relative to one another. In this construction, a respective conductor is twisted and engaged with a respective threaded member as the portions are rotated when a conductor is inserted through a respective cavity and threaded member. An outer surface proximate respective ends of the wire housing 20 may include a plurality of ribs 29*a*, wings 29*b* or other grip material to enhance a user's ability to grip and rotate the wire housing portions.

Figure 2D:
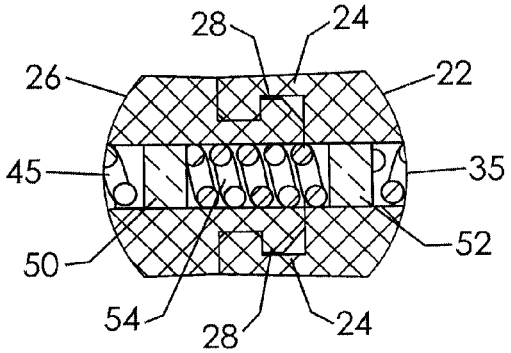
FIG. 2*d* is an isolated view on an enlarged scale taken from FIG. 2*c;*
Figure 2E:
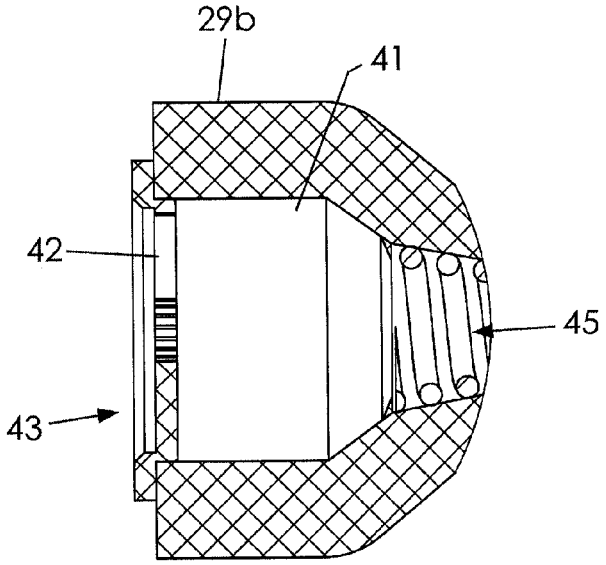
FIG. 2*e* is an isolated view on an enlarged scale taken from FIG. 2*c;*

The conductivity between the first threaded member 35 and the second threaded member 45 may be enhanced by inclusion of one or more copper inserts. In an embodiment, a first copper insert 50 is situated proximate the inner end of the first portion 22 and is in conductive communication with the first threaded member 35. Likewise, a second copper insert 52 is situated proximate the inner end of the second portion 26 and is in conductive communication with the second threaded member 45. It is understood that the copper inserts may provide a more complete and efficient transfer of current between the metallic threaded members and, as a result, between the first and second conductors. In addition, an auxiliary conductor 54, such as a metal spring, may be situated and in conductive content between the first and second copper inserts 50, 52 so as to further enhance the conductivity therebetween (FIG. 2*d*).

Figure 3A:
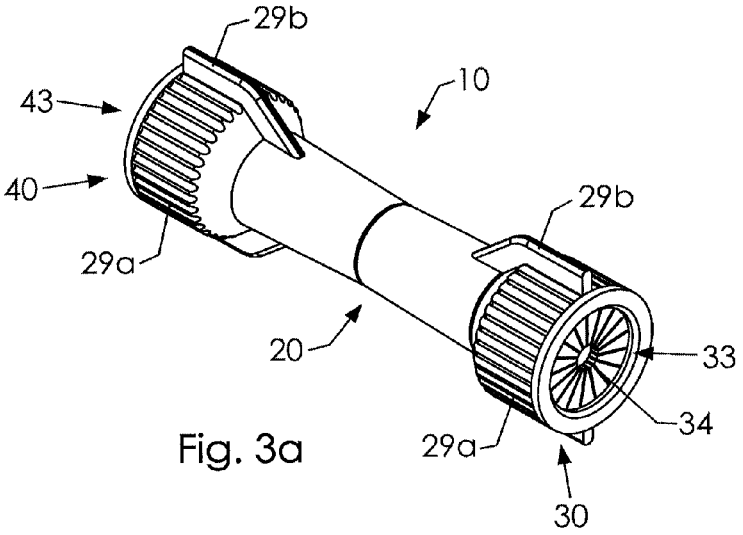
FIG. 3*a* is a perspective view of an electrical wire connector according to another embodiment of the present invention.
Figure 3B:
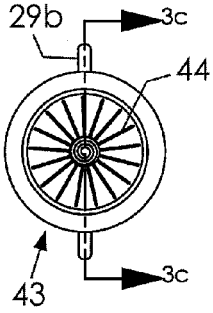
FIG. 3*b* is an end view of the wire connector as in FIG. 3*a;*
Figure 3C:
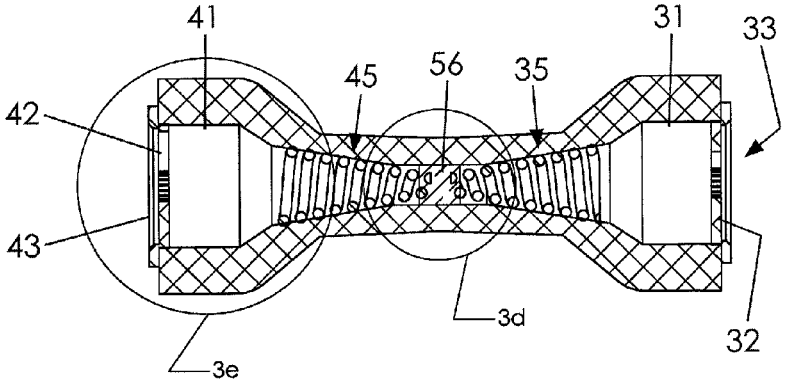
FIG. 3*c* is a sectional view taken along line 3*c*-3*c* of FIG. 3*b;*
Figure 3D:
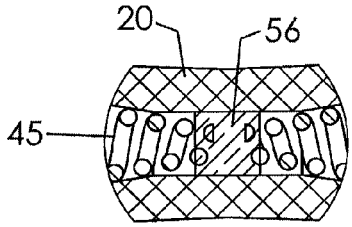
FIG. 3*d* is an isolated view on an enlarged scale taken from FIG. 3*c;*
Figure 3E:
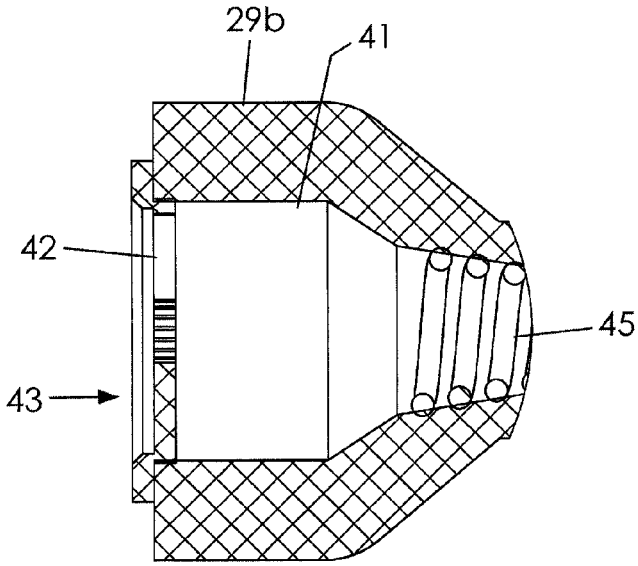
FIG. 3*e* is an isolated view on an enlarged scale taken from FIG. 3*c;*

In an embodiment, a fuse 56 may be positioned in the space between the first threaded member 35 and the second threaded member 45 (FIG. 3*c*). The fuse 56 is in electrical contact with both so as to detect the current flowing from one to the other. A fuse 56, of course, is a safety device, usually a strip of wire, that melts or breaks when a predetermined current is exceeded. Once broken or "tripped," the electrical circuit is broken and current is no longer conducted. In the present invention, if an excess current attempts to be conducted between the two conductors inserted into respective receptacles 30, 40 the fuse 56 will fail and no current will be conducted.

Figure 4A:
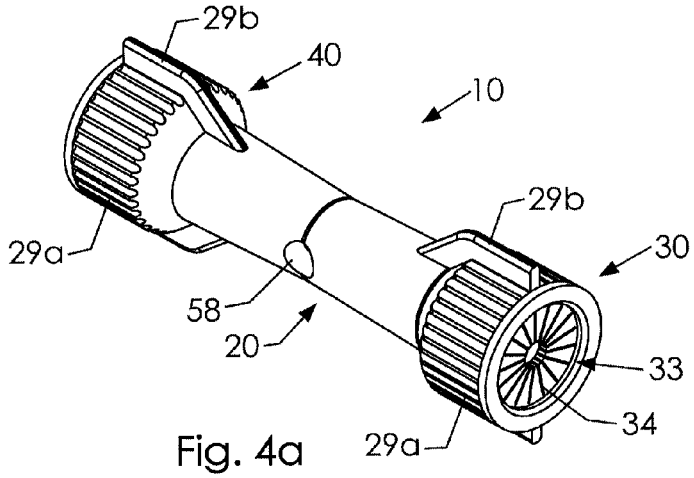
FIG. 4*a* is a perspective view of an electrical wire connector according to another embodiment of the present invention.
Figure 4B:
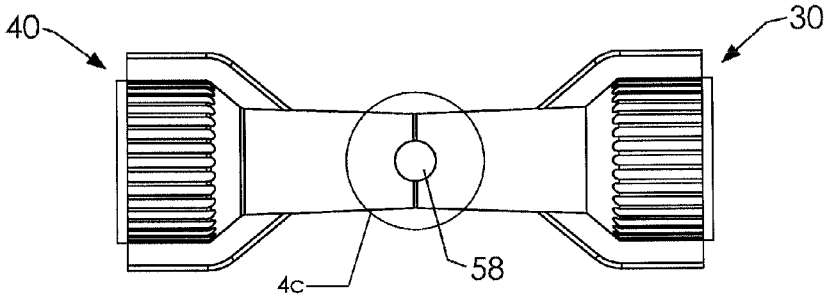
FIG. 4*b* is a side view of the wire connector as in FIG. 4*a*.
Figure 4C:
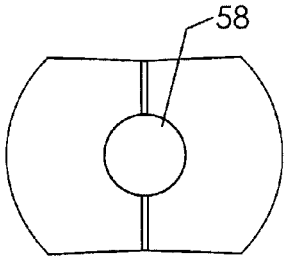
FIG. 4*c* is an isolated view on an enlarged scale taken from FIG. 4*b*.

In an embodiment shown in FIGS. 4*a* to 4*c*, the wire housing 20 defines an aperture 58 situated between the first receptacle 30 and the second receptacle 40, the aperture 58 configured to allow visual inspection of the fuse 56. In other words, a user is able to visually determine if the fuse 56 has melted or otherwise failed. In such case, the wire connector 10 may need to be disposed of as repair and replacement of the fuse 56 may not be feasible. It is understood that the fuse 56 and aperture 58 for viewing the fuse 56 may be used with any of the embodiments previously described.

In use, a first conductive wire (a.k.a. a "first conductor") may be inserted through the first wire capturing mechanism 33 into the first cavity 31 and into engagement with the first threaded member 35. Likewise, a second conductive wire (a.k.a. a "second conductor") may be inserted through the second wire capturing mechanism 43 into the second cavity 41 and into engagement with the second threaded member 45. Accordingly, the first and second conductors are now electrically connected as described above.

Although the invention has been explained in relation to its preferred embodiment, it is to be understood that many other possible modifications and variations can be made without departing from the spirit and scope of the invention. It is understood that while certain forms of this invention have been illustrated and described, it is not limited thereto except insofar as such limitations are included in the following claims and allowable functional equivalents thereof.

The invention claimed is:

1. An electrical wire connector for use in splicing a first conductor and a second conductor in waterproof electrical communication, said electrical wire connector comprising:

a wire housing having a first receptacle defining a first interior cavity and a first open end selectively allowing access to said first interior cavity and a second receptacle defining a second interior cavity and a second open end selectively allowing access to said second interior cavity, said first and second receptacles being operatively coupled to one another and said first and second open ends being opposite one another;

a first wire capturing mechanism situated in said first opening and a second wire capturing mechanism situated in said second opening, said first and second wire capturing mechanism being configured to restrict movement of a respective conductor once inserted therethrough;

wherein said first receptacle includes a first threaded member adjacent said first interior cavity and said second receptacle includes a second threaded member adjacent said second interior cavity, said first and second threaded members being constructed of conductive material;

wherein said first threaded member is in operative conductive communication with said second threaded member such that current is conducted between the first conductor and the second conductor when inserted into said first and said second receptacles, respectively;

wherein said wire housing includes a two piece construction having a first portion rotatably coupled to said second portion such that said second portion is selectively rotated relative so as to more tightly engage the second conductor about the second threaded member when the second conductor is inserted into the second receptacle;

wherein:

said wire housing has a generally cylindrical configuration;

said first portion includes an inner end defining a continuous recess extending circumferentially around said inner end;

said second portion includes an inner end having a flange nested in said recess and configured to slide rotatably thereabout so that said second portion is axially rotatable relative thereto.

2. The electrical wire connector as in claim 1, wherein:

said first wire capturing mechanism includes a plurality of latching protrusions extending radially about an opening configured to restrict movement of a respective conductor once inserted through said hole; and said second wire capturing mechanism includes a plurality of latching protrusions extending radially about an opening configured to restrict movement of another respective conductor once inserted through said hole.

3. The electrical wire connector as in claim 1, wherein:

said first threaded member has a generally conical shape with a decreasing diameter for receiving a male end of the first conductor when inserted through said first open end and said first cavity;

said second threaded member has a generally conical shape with a decreasing diameter for receiving a male end of the second conductor when inserted through said second open end and said second cavity.

4. The electrical wire connector as in claim 1, wherein:

said first threaded member includes a first spring;

said first threaded member includes a first spring;

said first spring is welded to said second spring within said wire housing.

5. The electrical wire connector as in claim 1, wherein said wire housing includes an outer layer having an insulated, non-conductive construction.

6. The electrical wire connector as in claim 2, wherein:

said latching protrusions of said first wire capturing mechanism include a waterproofing material such that first wire capturing mechanism forms a watertight barrier when the first conductor is inserted through said latching protrusions; and said latching protrusions of said second wire capturing mechanism include a waterproofing material such that second wire capturing mechanism forms a watertight barrier when the second conductor is inserted through said latching protrusions.

7. The electrical wire connector as in claim 6, wherein the waterproofing material is situated within the opening of said first and second wire capturing mechanisms, respectfully, so as to envelop the first and second conductor when inserted therethrough, respectively.

8. The electrical wire connector as in claim 7, wherein the waterproofing material is a viscous silicon adhesive contained within a package and released under pressure.

9. The electrical wire connector as in claim 1, wherein said wire housing includes a one piece construction.

10. The electrical wire connector as in claim 1, comprising:

a first copper insert situated proximate said inner end of said first portion and in conductive communication with said first threaded member;

a second copper insert situated proximate said inner end of said first portion and in conductive communication with said second threaded member.

11. The electrical wire connector as in claim 10, comprising an auxiliary conductor extending between said first copper insert and said second copper insert and configured to transfer current between said first threaded member and said second threaded member.

12. An electrical wire connector for use in splicing a first conductor and a second conductor in waterproof electrical communication, said electrical wire connector comprising:

a wire housing having a first receptacle defining a first interior cavity and a first open end selectively allowing access to said first interior cavity and a second receptacle defining a second interior cavity and a second open end selectively allowing access to said second interior cavity, said first and second receptacles being operatively coupled to one another and said first and second open ends being opposite one another;

a first wire capturing mechanism situated in said first opening and a second wire capturing mechanism situated in said second opening, said first and second wire capturing mechanism being configured to restrict movement of a respective conductor once inserted therethrough;

wherein said first receptacle includes a first threaded member adjacent said first interior cavity and said second receptacle includes a second threaded member adjacent said second interior cavity, said first and second threaded members being constructed of conductive material;

wherein said first threaded member is in operative conductive communication with said second threaded member such that current is conducted between the first conductor and the second conductor when inserted into said first and said second receptacles, respectively;

a fuse positioned between and in conductive communication with said first threaded member and said second threaded member, said fuse configured to fail and prevent conduction of current between said first threaded member and said second threaded member when current exceeding a predetermined voltage is detected.

13. The electrical wire connector as in claim 12, wherein said wire housing defines an aperture situated between said first receptacle and said second receptacle, said aperture configured to allow visual inspection of said fuse.

14. The electrical wire connector as in claim 12, further comprising a fuse positioned between and in conductive communication with said first threaded member and said second threaded member, said fuse configured to fail and prevent conduction of current between said first threaded member and said second threaded member when current exceeding a predetermined voltage is detected.

15. The electrical wire connector as in claim 14, wherein said wire housing defines an aperture situated between said first receptacle and said second receptacle, said aperture configured to allow visual inspection of said fuse.

16. The electrical wire connector as in claim 12, further comprising a fuse positioned between and in conductive communication with said first threaded member and said second threaded member, said fuse configured to fail and prevent conduction of current between said first threaded member and said second threaded member when current exceeding a predetermined voltage is detected.

17. The electrical wire connector as in claim 16, wherein said wire housing defines an aperture situated between said first receptacle and said second receptacle, said aperture configured to allow visual inspection of said fuse.

* * * * *